US009225126B2

(12) United States Patent
Janfada et al.

(10) Patent No.: US 9,225,126 B2
(45) Date of Patent: Dec. 29, 2015

(54) MAGNETICALLY ACTUATED AC POWER CONNECTOR

(71) Applicants: Arash Janfada, Saskastoon (CA); William Topping, Prince Albert (CA)

(72) Inventors: Arash Janfada, Saskastoon (CA); William Topping, Prince Albert (CA)

(73) Assignee: Magno Plug Products Inc., Vancouver, BC (CA)

( * ) Notice: Subject to any disclaimer, the term of this patent is extended or adjusted under 35 U.S.C. 154(b) by 50 days.

(21) Appl. No.: 13/859,677

(22) Filed: Apr. 9, 2013

(65) Prior Publication Data

US 2014/0302691 A1 Oct. 9, 2014

(51) Int. Cl.

| | |
|---|---|
| ***H01R 13/60*** | (2006.01) |
| ***H01R 13/703*** | (2006.01) |
| *H01R 103/00* | (2006.01) |
| *H01R 24/78* | (2011.01) |

(52) U.S. Cl.
CPC ..... *H01R 13/7037* (2013.01); *H01R 24/78* (2013.01); *H01R 2103/00* (2013.01)

(58) Field of Classification Search
CPC ..... H01R 13/6205
USPC ..... 438/39, 188; 200/51.09
See application file for complete search history.

(56) References Cited

U.S. PATENT DOCUMENTS

| | | | | |
|---|---|---|---|---|
| 2,573,920 | A * | 11/1951 | McLeod | 200/51.09 |
| 3,144,527 | A * | 8/1964 | Tolegian | 200/51.09 |
| 3,521,216 | A * | 7/1970 | Tolegian | 439/39 |
| 4,317,969 | A * | 3/1982 | Riegler et al. | 200/52 R |
| 4,451,113 | A * | 5/1984 | Zuniga | 439/40 |
| 4,647,120 | A * | 3/1987 | Karabakakis | 439/39 |
| 4,874,316 | A * | 10/1989 | Kamon et al. | 439/39 |
| 5,567,175 | A * | 10/1996 | Warden et al. | 439/490 |
| 5,954,520 | A * | 9/1999 | Schmidt | 439/39 |
| 6,528,746 | B2 * | 3/2003 | DeWitt et al. | 200/51.09 |
| 6,561,815 | B1 * | 5/2003 | Schmidt | 439/38 |
| 6,966,781 | B1 * | 11/2005 | Bullinger et al. | 439/38 |
| 7,056,127 | B2 * | 6/2006 | Suzuki et al. | 439/39 |
| 7,311,526 | B2 * | 12/2007 | Rohrbach et al. | 439/39 |
| 7,736,033 | B2 * | 6/2010 | Patel | 362/414 |
| 7,775,801 | B2 * | 8/2010 | Shiff et al. | 439/39 |
| 8,651,876 | B2 * | 2/2014 | Mysliwiec et al. | 439/39 |
| 8,988,043 | B2 * | 3/2015 | Alammari | H02J 7/00 320/111 |
| 2009/0309542 | A1 * | 12/2009 | Hung et al. | 320/111 |
| 2014/0176071 | A1 * | 6/2014 | Alammari | 320/111 |
| 2014/0302691 | A1 * | 10/2014 | Janfada | H01R 13/7037 439/39 |

* cited by examiner

*Primary Examiner* — Neil Abrams
(74) *Attorney, Agent, or Firm* — Susan M. Ben-Oliel

(57) ABSTRACT

An apparatus for electrically connecting a power source to an electrical device is disclosed. The apparatus comprises a first component and a second component. The first component has a substantially planar contoured first face comprising a ferromagnetic plate, a first set of contacts electrically connectable to a power source, two power switches and a magnetically actuated sensor controlling the switches. The second component has a substantially planar contoured second face complementary to the first face comprising a magnet and a second set of electrically conductive contacts electrically connectable to a device. Connecting the first and second faces, results in the first and second pair of contacts electrically coupling and establishes an electrical path between the power source and the device, and connects the components by magnetic attractive force which actuates the power switches and initiates power to the device. The apparatus further comprises a safety circuit for preventing electric shock.

7 Claims, 6 Drawing Sheets

MAGNETICALLY ACTUATED AC POWER CONNECTOR

CROSS REFERENCE TO RELATED APPLICATIONS

This application relates to a Provisional Application which was electronically filed on Apr. 30, 2012, and given application Ser. No. 61/640,002, EFS ID 12656459 and Confirmation Number 1024.

FIELD OF INVENTION

This invention relates to a power connector and, in particular, a power connector without probes for electrical connection.

BACKGROUND OF THE INVENTION

Conventional power connectors comprise of a male plug component having contact prongs extending outwards for inserting into a corresponding receiving member in a female plug component or a socket, where the receiving member holds the prongs in place and the male and female plug components are electrically connected using frictional force. In some situations, for example in very low temperatures, the insertion and removal of the prongs becomes difficult and may cause damage to the cord and devices connect to the cord.

U.S. Pat. No. 7,311,526 disclosed a magnetic connector that connects a direct current (DC) power supply to a device. Such connector has safety issues if used for transmitting high voltage alternative current (AC) signal, as electric shock may occur when the user touches electrically live high voltage exposed contacts. Therefore an improved power connector design is desired to accommodate high voltage AC electric power supplies. Other power connector systems that may share common design features with the current system are shown in the following patents:

| | |
|---|---|
| 7,621,753 | Pai |
| 7,874,844 | Fitts |
| 7,442,042 | Lewis |
| 6,739,915 | Hyland |
| 7,339,205 | McNeely |
| 6,770,986 | Nagao |
| 5,584,715 | Ehrenfels |
| 4,748,343 | Engel |
| 7,351,066 | DiFonzo |
| 7,517,222 | Rohrbach |
| 7,645,143 | Rohrbach |

SUMMARY OF THE INVENTION

In the light of the foregoing background, it is an object of the present invention to provide an alternate power connector.

Accordingly, the present invention, in one aspect, is an apparatus for electrically connecting a power source to an electrical device. The apparatus comprises a first component and a second component. The first component has a substantially planar contoured first face, and the first face comprises, in part, a set of 3 electrical pad contacts, one for each: hot, neutral, and ground connected to the power source. The second component has a substantially planar contoured second face complementary to the first face, and the second face comprises, in part, a set of 3 electrical pad contacts, one for each: hot, neutral, and ground connected to the electrical device. The first set of contacts becomes electrically coupled to the second set of contacts upon connecting the first face with the second face, thereby establishing a first (primary) electrical path between the power source and the electronic device.

In an exemplary embodiment of the present invention, the power source may be any standard household AC supply outlet and the primary electrical path is an AC supply path between the outlet and the electronic device. The first plug component further comprises power rectifier circuitry which branches off from the primary path and supplies DC power via a secondary electrical path to internal power switching circuitry.

In a another exemplary embodiment, the power connector further comprises at least one electrically operated switch and one actuating sensor. The switch is initially in the off position and is disposed in the primary electrical path. The actuating member is disposed in the secondary electrical path. When the first and second faces are attached, the actuating sensor is triggered by the presence of the magnet and closes the switch located in the first electrical path resulting in power conduction to the electronic device.

In another exemplary embodiment of the present invention, the male plug face comprises a ferromagnetic element and the female plug face comprises a magnetic element. The primary electrical path is established upon connecting the male plug face comprising of a ferromagnetic element, to the female plug face comprising a magnetic element, whereby the presence of the magnet on the female plug face triggers the actuating sensor inside the male plug component and closes the switch disposed in the primary electrical path and results in power conduction. In addition to actuating power conduction, the attractive force between the ferromagnetic and magnetic plates, on the male and female faces respectively, binds the plug components together allowing the electrical coupling between the pad contacts to be maintained during plug operation.

There are many advantages to the present invention. First of all, the male plug component and the female plug component (i.e. the first component and the second component) are held together by non-frictional forces such as magnetic forces, and the contact face between the components is substantially planar and contoured. Attaching the components is simply completed by contacting the male plug face with the female plug face. Separating the components requires minimal pulling force and as a result will not cause any damage to the components in low temperatures due to excessive friction force caused by variable temperature induced contraction of components. The performance of the substantially planar contoured contact face is not affected by contraction and expansion due to changes in ambient temperature. As a result, the force required to separate the plug components is also independent of ambient temperature.

The strength of the magnetic force is chosen to be removable with deliberate force but is considerably less than the maximum connective force of other connections, such that in situations where the device is pulled from the power supply with excessive force, the magnetic coupling between the male plug component and the female plug component of the power cord is always first to break, preventing damage to the device and the power supply. An example of such situation is in engine block heaters in vehicles where the user may drive a vehicle away from its parked position without noticing that the block heater cord is connected to a wall socket via an extension cord, a common practice used to keep the engine warm enough to be started in cold climates.

Another advantage of the present invention is that the circuit is designed to prevent the electrical contacts from being live with AC power when the male plug component is connected to the power source but not to the female plug. In the absence of the safety shut off mechanism, a user would suffer electric shock upon touching an electrically live contact. Using an electrically operated switching mechanism as a part of the circuit ensures that the power transmission components are only actuated when the male plug face is in contact with the female plug face, which in the case of the present invention means that the contacts are accurately connected between the corresponding male and female plug components.

Another advantage of the present invention is that the power connector has no moving parts and the surface of contact is substantially planar and contoured, therefore debris such as dust, dirt or ice will not easily collect on the components and potentially affect the operation of the connector such as shorting the circuit, especially so if the power connector is to be usable in outdoor environments. Where debris does collect on the contact surfaces, the surfaces can be readily wiped clean due to their substantially planer nature.

An additional advantage of the present invention is that the electrical contacts located on the male plug face will be slightly recessed below the contact surface of the ferromagnetic plate located on the contact face. This is primarily a safety feature which further reduces the chance of electric shock if a metal object is accidentally lodged between the male and female plug face when they are connected and the system is actuated to the on-position by the presence of the magnet.

DETAILED DESCRIPTION OF THE PREFERRED EMBODIMENTS

As used herein and in the claims, "comprising" means including the following elements but not excluding others.

As used herein and in the claims, "couple" or "connect" refers to electrical coupling or connection either directly or indirectly via one or more electrical means unless otherwise stated.

Figure 1:
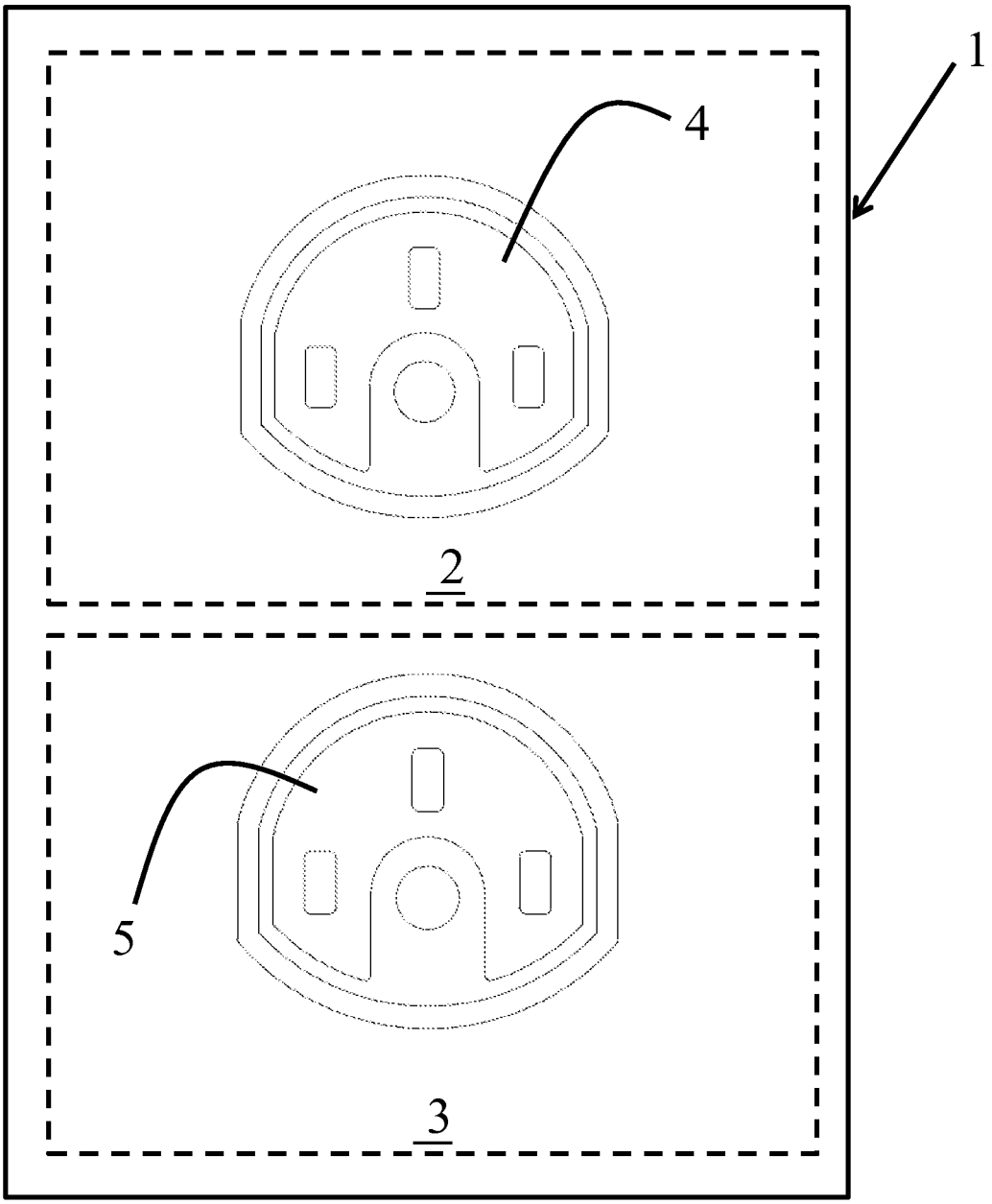
FIG. 1 is a block diagram of the power connector male and female faces according to an embodiment of the present invention.
Figure 2:
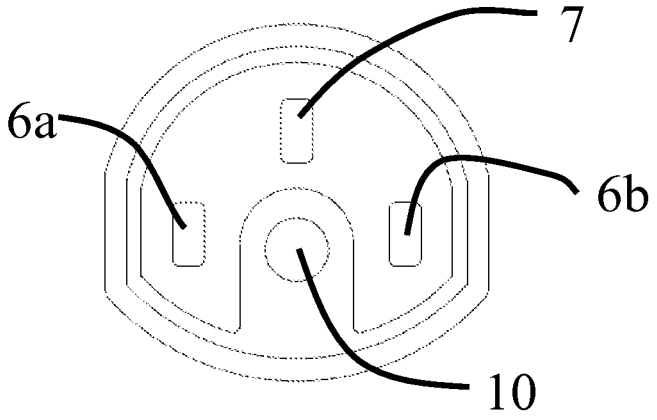
FIG. 2 is a front view of a male plug face according to an embodiment of the present invention.
Figure 3:
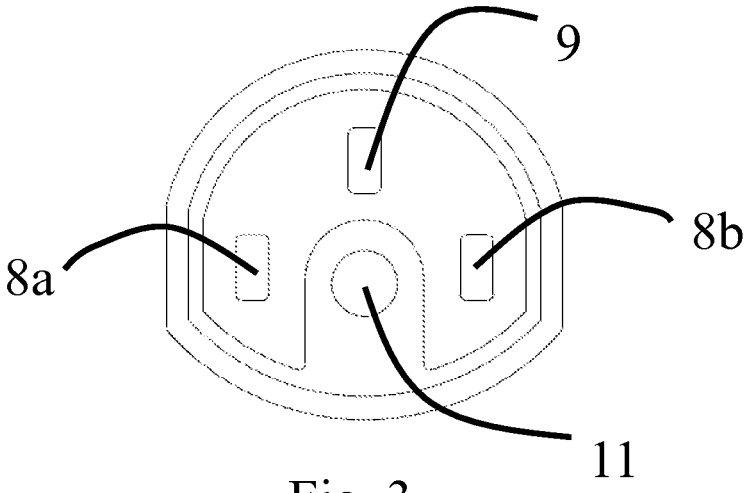
FIG. 3 is a front view of a female plug face according to an embodiment of the present invention.

Referring now to FIGS. 1, 2 and 3, the first embodiment of the present invention is a power connector 1 comprising a male plug component 2 and a female plug component 3. The male plug component 2 has a standard male power supply connector at the rear (not shown) adapted to connect to a power supply such as a wall socket. The female plug component 3 has a standard female connector at the rear (not shown) adapted to connect to an external electrical device to be powered. The male plug component 2 further comprises a male plug face 4 which is substantially planar and contoured, and the female plug component 3 further comprises a female plug face 5 which is also substantially planar and contoured. There is at least one set of contacts on the male plug face 4. In the specific example as shown in FIG. 2, there are three (3) electrical pad contacts, one for each: hot, neutral, and ground denoted by 6*a*, 6*b* and 7 respectively. There is also at least one set of contacts on the female plug face 3. In the specific example as shown in FIG. 3, there are three (3) electrical pad contacts, one for each: hot, neutral, and ground, denoted by 8*a*, 8*b* and 9 respectively. The contour of the male plug face 2 and the female plug face 3 are complementary to each other such that the entire male plug face 2 can be contacted to the female plug face 3.

In operation of the power connector 1, the male plug component 2 is brought into contact with the female plug component 3. The entire male plug face 4 is in contact with the female plug face 5 due to their substantially planer and complementary construction. When the two faces are in contact, the first set of three contacts 6*a*, 6*b* and 7 are electrically coupled to the corresponding second set of three contacts, 8*a*, 8*b* and 9. This completes the electrical path between the power supply and the electrical device. As a result, electric power can flow from the power supply to the electrical device.

In an exemplary embodiment, referring to FIG. 2 and FIG. 3, one ferromagnetic element 10 is disposed on the male plug face 4, and at least one magnetic element 11 is disposed on the female plug face 5. The ferromagnetic element 10 and the magnetic element 11 become connected through magnetic attractive force when the male plug face 4 is brought into contact with the female plug face 5, thus attaching the male plug component 2 to the female plug component 3 and vice versa. In a further embodiment, the ferromagnetic element 10 and the magnetic element 11 are installed at predetermined locations in the male plug component 2 and the female plug component 3 respectively, such that the male plug component 2 can only be attached to the female plug component 3 in a predetermined orientation, where the predetermined orientation ensures the electrical path to be established in a safe manner and isolates the individual electrical pad contacts located on each of the plug faces.

Magnetic elements generate magnetic fields. When one magnetic element 10 is brought into proximity of a ferromagnetic element 11, a magnetic attractive force is generated between the two elements. The magnetic force acts substantially along the axis of the magnetic element. As such, in the present invention, when the male plug face 4 is brought into proximity of the female plug face 5, a magnetic attractive force is generated perpendicular to the male plug face 4 and the female plug face 5 causing them to attach. The magnetic force prevents the components from detaching once connected unless sufficient external force is applied to detach the components.

Figure 4A:
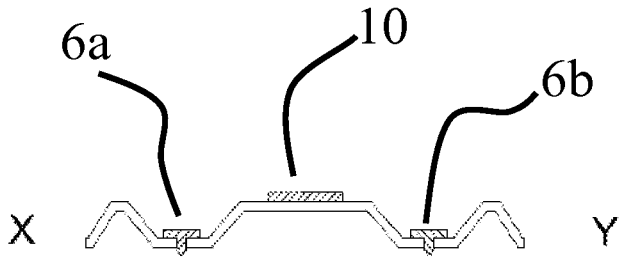
FIG. 4*a* is a cutaway cross-section (X-Y) of the contoured male plug face according to an embodiment of the present invention.
Figure 4B:
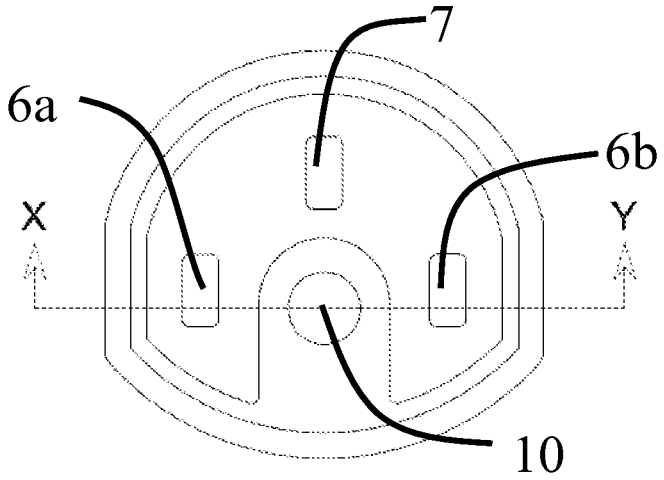
FIG. 4*b* is a front view of the male plug face showing the location of cross-section (X-Y) according to an embodiment of the present invention.
Figure 5A:
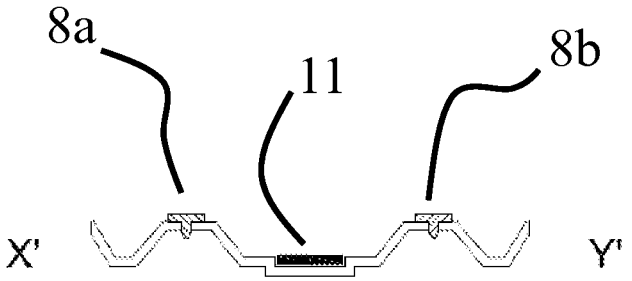
FIG. 5*a* is a cutaway cross-section (X'-Y') of the contoured female plug face according to an embodiment of the present invention.
Figure 5B:
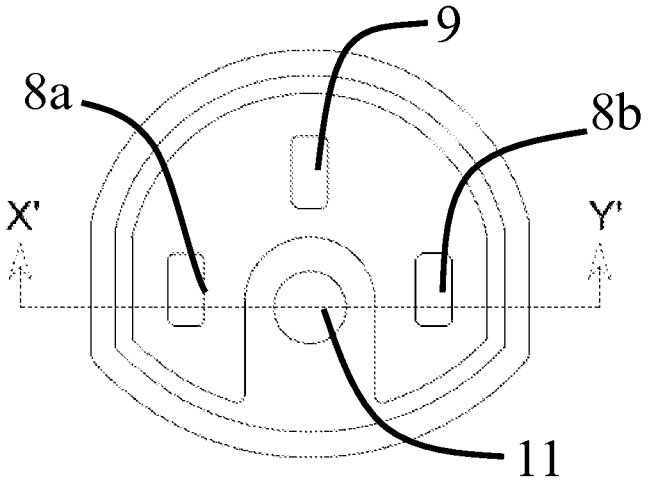
FIG. 5*b* is a front view of the female plug face showing the location of cross-section (X'-Y') according to an embodiment of the present invention.

In another exemplary embodiment, FIG. 4*a* and FIG. 4*b* show cross-section cutaways of the male plug face 4, and FIG. 5*a* and FIG. 5*b* show cross-section cutaways for the female plug face 5. The cross-sections show the substantially planer and complementary contoured design of the plug faces. The electrical contacts on the male plug face 4 are 6*a*, 6*b* and 7 and are recessed within the contoured folds of the male and plug. Since the electrical pad contacts (6*a*, 6*b* and 7) on the male plug face 4 have to potential to be live when the system is actuated, this recessed design ensures additional safety and creates asymmetrical contours on the substantially planer face which ensure that the male plug face 4 and female plug face 5 only connect in one specific orientation.

In an exemplary embodiment, the magnetic element 11 is a permanent magnet, made of neodymium-iron-boron or samarium cobalt type disc or ring magnet. The magnetic force generated will be calibrated to be strong enough to prevent unintentional detachment but not too strong for possible damage to other parts, such as the power supply cable or the electrical device, before the connector components can be detached either accidentally or intentionally. Preferably, a force between approximately 3 lbs to 5 lbs should be produced between the magnetic and ferromagnetic elements.

In another exemplary embodiment, a disc-type magnet has a diameter of 0.375 inch or 0.5 inch and a thickness ranging from 0.1 inch to 0.125 inch. In yet another exemplary embodiment, a ring-type magnet has an outer diameter of 0.375 inch to 0.5 inch, an inner diameter of 0.125 inch and a thickness ranging from 0.1 inch to 0.125 inch.

Figure 6:
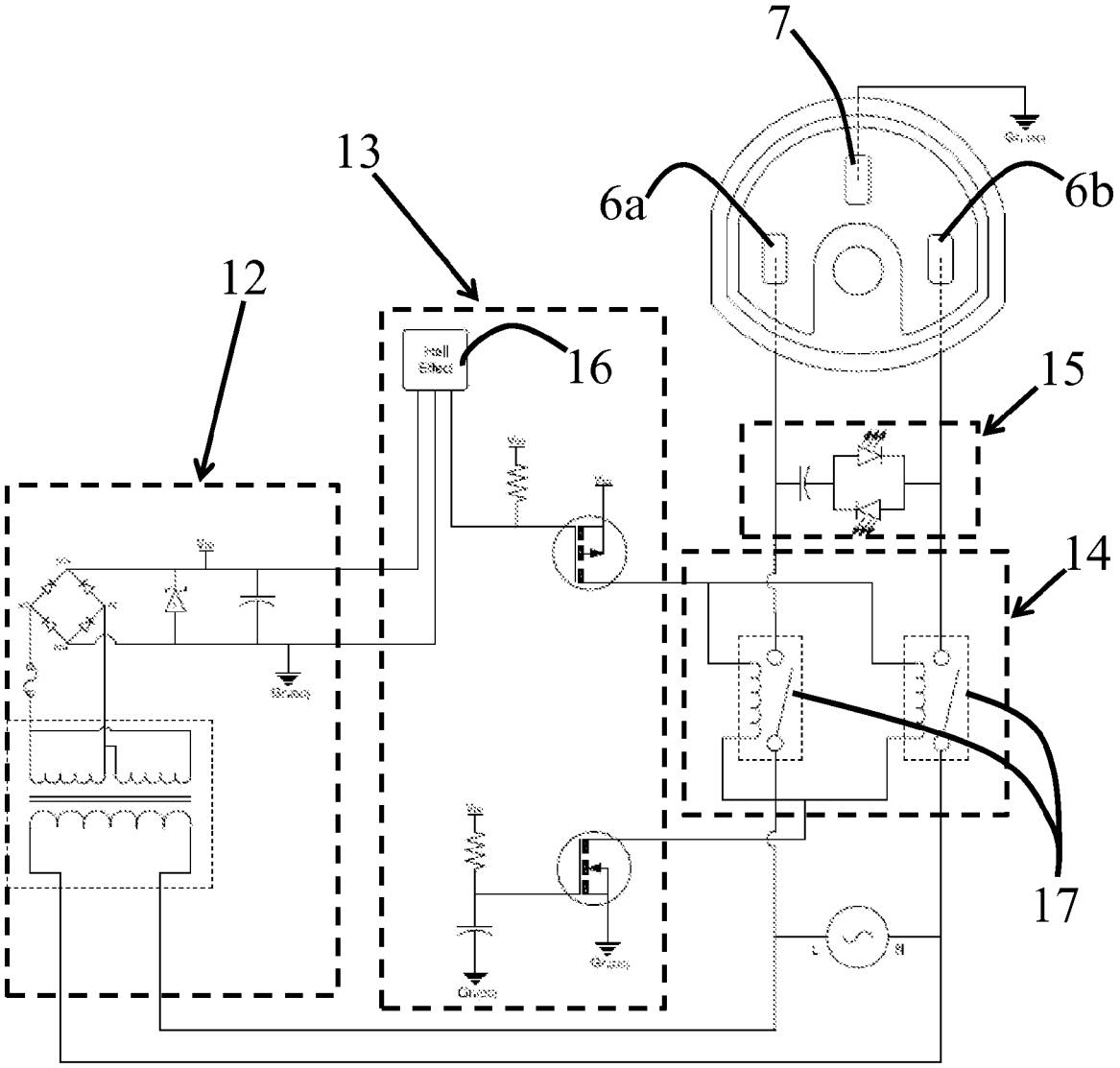
FIG. 6 is a complete circuit diagram of the power connector circuitry of the male plug component according to an embodiment of the present invention.

In an exemplary embodiment, an electric circuit is provided to control the establishment of the electrical path. Referring to FIG. 6, three circuit component-groups are disposed in the male plug component 2 each of which perform a separate function while working together to activate the plug system. The AC/DC power supply component-group 12 converts conventional household power (120 volt AC) into a low-voltage direct current (DC) supply. The AC/DC power supply component-group 12 is connected to the 120 volt AC power source (house power plug) on one end and on the other end is connected to the sensor and switching component-group 13. The sensor and switching component-group 13 performs the function of detecting the presence of a magnetic field. As shown in FIG. 6, this component-group is connected to the AC/DC power source component-group 12 at one end, and on the other is connected to the power transmission component-group 14. The power transmission is attached to a standard residential power supply at one end, and to the hot and neutral contacts (6*a*, 6*b*) on the male plug face 4 on the other. A final component group is place between the power transmission component-group and the contacts 6*a* and 6*b* on the male plug face 4. This is the indicator light component group 15 which consists of two light-emitting-diodes (LED) in parallel, and a capacitor in series with the LEDs. The indicator light component group informs the plug system operator that the relays are engaged and that power is being transmitted by the system.

Referring to FIGS. 2, 3 and 6, at least one electronic sensor and one electrically operated switch is disposed in the male plug component 2. In a specific embodiment as shown in FIG. 6, one hall-effect switch 16 is disposed inside the male plug component 2, and two power relay type switches 17 are disposed inside the male plug component 2. The system is powered on when the hall-effect sensor 16 in the male plug component 2 senses the presence of a magnetic field from the magnet disposed on the female plug face 5. When the male plug component 2 and female plug component 3 are connected, they attach by magnetic attraction force between the magnet 11 disposed on the female plug face 5 and the ferromagnetic plate 10 disposed on the male plug face 4. Simultaneous with the connection of the plug components, the hall-effect sensor 16 detects the presence of the magnetic field and begins to provides current to the coil of the power relay switches 17. This triggers the relays into the "on" position where they begin to conduct AC power to the attached electric device. The relay power output terminals are electrically connected to contacts 6*a* and 6*b* disposed on the male plug face 4.

Figure 7:
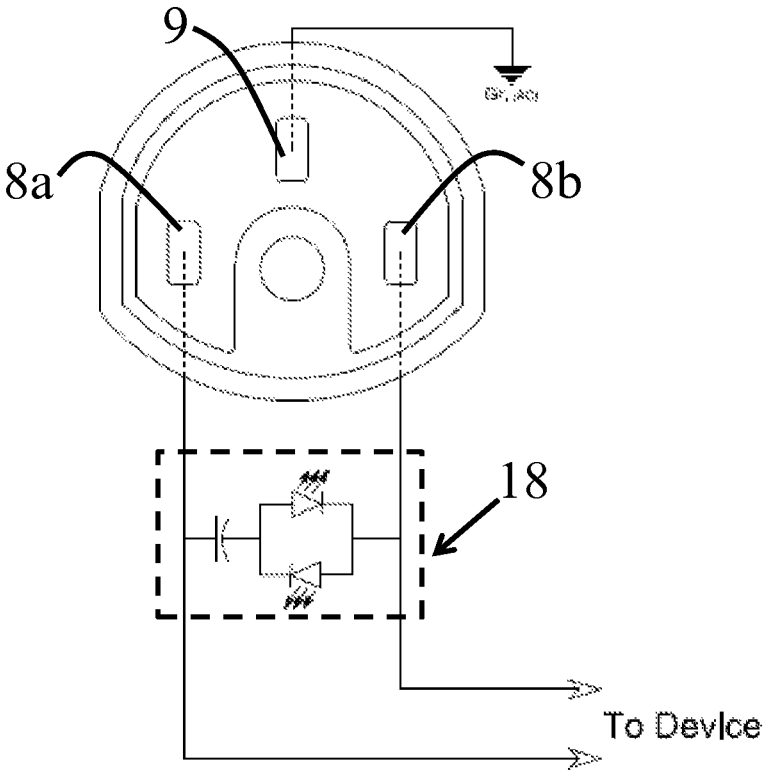
FIG. 7 is a complete circuit diagram of the power connector circuitry of the female plug component according to an embodiment of the present invention.

In a further exemplary embodiment, with reference to FIG. 1, FIG. 6 and FIG. 7, when the male plug component 2 and female plug component 3 are attached, contacts 6*a*, 6*b* and 7 disposed on the male plug face 4 are in direct contact with contacts 8*a*, 8*b* and 9 disposed on the female face. The connection of the In turn the electric device is connected via the female plug component 3 to contacts 8*a* and 8*b* internally (FIG. 7). As a result power is transferred to the electronic device. When the user detaches the male plug component 2 from the female plug component 3, the magnet 13 and associated magnetic field is also removed from the vicinity of the Hall-Effect sensor 16 causing the Hall-Effect sensor to terminate current transfer to the coils of the relays. This causes the relays to return to the "off" position and stop the transition of power to contacts 6*a* and 6*b* making the system electronically inactive.

In an exemplary embodiment, the AC/DC conversion circuit is a transformer-based conversion circuit that outputs a 6V DC voltage.

In one embodiment, with reference to FIG. 7, an indicator circuit 19 is provided within the female plug component 3 electrically parallel to the device connecting wires of the female component 3 to alert the user when electric power is supplied to the electrical device. In an exemplary embodiment, the indicator 19 is a visual indicator light emitting diode (LED) circuit.

The exemplary embodiments of the present invention are thus fully described. Although the description referred to particular embodiments, it will be clear to one skilled in the art that the present invention may be practiced with variation of these specific details. Hence this invention should not be construed as limited to the embodiments set forth herein.

For example, the casing or external housing of the male 2 and female 3 plug components can be constructed of any rigid synthetic, semi-synthetic or organic composite polymeric material such as polyvinyl chloride, and can be constructed in any shape conductive to the adapted use, so long as the design parameters and functional constrains previously described are maintained.

In another example, a gasket can be provided surrounding the male plug face 6 and the female plug face 7. The gaskets then push against each other when the male plug face 2 is in contact with the female plug face 3, preventing external particles such as dust or ice to enter, causing damage to the power connector system.

In yet another example, the actuating element may be spring loaded piston within the male plug component upon which live electrical contacts are mounted. Once the male and female plug components are connected, the piston is drawn forward and electrically coupled with contacts on the female component thus transmitting power to a connected electronic device.

An AC/DC conversion circuit with transformer-less or capacitative elements can be used in place of a transformer conversion circuit with the same function. A transformer-less conversion circuit generally occupies less space.

It is obvious to one skilled in the art that the plug faces can be contoured in a way to improve alignment of the components, as long as an axial frictional force is not created during attachment. The construction and assembly of the embodiments previously described is accomplished through conventional means and uses conventional components and therefore should be consistent with the common general knowledge of a person skilled in the art.

What is claimed is:

1. An apparatus for electrically connecting a power source to an electrical device, comprising:

a first component having a substantially planar first face, said first face comprising a first set of 3 electrical pad contacts, one for each: hot, neutral, and ground connected to said power source;

a second component having a substantially planar second face complementary to said first face, said second face comprising a second set of 3 electrical pad contacts, one for each: hot, neutral, and around connected to said electrical device;

wherein each of said first set of electrical contacts comprises a first plate portion immovably fixed on said first face;

wherein each of said second set of electrical contacts comprises a second plate portion immovably fixed on said second face;

wherein said first plate portions of said first set of electrical contacts are disposed in a triangular fashion to define a first triangle on said first face;

wherein said second plate portions of said second set of electrical contacts are disposed in a triangular fashion to define a second triangle on said second face such that said first triangle and said second triangle are congruent to each other; and wherein a shape of said first face and a shape of said second face are complementary to each other so that, when said first component is attached to said second component, said first plate portions of said first set of electrical contacts are brought in direct contact with said second plate portions of said second set of electrical contacts, respectively, at vertices of said first and second triangles, thereby electronically coupling said first set of electrical contacts to said second set of electrical contacts to establish an electrical path between said power source and said electrical device; and wherein said first component comprises a ferromagnetic element and said second component comprises a magnetic element, whereby said electrical path is established upon magnetically coupling said ferromagnetic element to said magnetic element, wherein said ferromagnetic element and said magnetic element are installed at predetermined locations in said first component and said second component, respectively, such that said first component can only be attached to said second component in a predetermined orientation, where said predetermined orientation ensures said electrical path to be established, wherein said first face of said first component has a raised portion, said ferromagnetic element being installed on the raise portion at substantially a central location of the first triangle on said first face, and wherein said second face of said second component has a lowered portion that is to be intermeshed with said raised portion of said first face of said first component, said magnetic element being installed on the lowered portion at substantially a central location of the second triangle on said second face.

2. An apparatus for electrically connecting a power source to an electrical device, comprising:

a first component having a substantially planar first face, said first face comprising a first set of 3 electrical pad contacts, one for each: hot, neutral, and ground connected to said power source;

a second component having a substantially planar second face complementary to said first face, said second face comprising a second set of 8 electrical Dad contacts, one for each: hot, neutral, and around connected to said electrical device;

wherein each of said first set of electrical contacts comprises a first plate portion immovably fixed on said first face;

wherein each of said second set of electrical contacts comprises a second plate portion immovably fixed on said second face;

wherein said first plate portions of said first set of electrical contacts are disposed in a triangular fashion to define a first triangle on said first face;

wherein said second plate portions of said second set of electrical contacts are disposed in a triangular fashion to define a second triangle on said second face such that said first triangle and said second triangle are congruent to each other;

wherein a shape of said first face and a shape of said second face are complementary to each other so that, when said first component is attached to said second component, said first late portions of said first set of electrical contacts are brought in direct contact with said second plate portions of said second set of electrical contacts, respectively, at vertices of said first and second triangles, thereby electronically coupling said first set of electrical contacts to said second get of electrical contacts to establish an electrical path between said power source and said electrical device;

wherein said power source is an AC supply source, said electrical path is a first electrical path as an AC supply path, and said first component further comprises a power rectification circuit branching off from the AC supply path and rectifying the AC supply to a DC supply for operation of a second electrical path; and wherein the apparatus further comprising at least one electrically operated sensor and at least one electrically operated switchable member initially in an open state, wherein said sensor is disposed in said second electrical path and connected to said switchable member, and said switchable member is disposed in said first electrical path, and wherein connecting said first and second components causes said sensor to switch said switchable member to a closed state, thereby establishing power transmission.

3. The apparatus according to claim 2, wherein said electrically operated sensor is a hall-effect sensor and said switchable member consists of a pair of power relay switches one of each: hot and neutral electrical connections, wherein said first component comprises a ferromagnetic element and said second component comprises a magnetic element, whereby said first electrical path is established upon magnetically coupling said ferromagnetic element to said magnetic element, wherein said ferromagnetic element and said magnetic element are installed at predetermined locations in said first component and said second component, respectively, such that said first component can only be attached to said second component in a predetermined orientation, where said predetermined orientation ensures said first electrical path to be established, wherein said ferromagnetic element and said magnetic element are installed such that, when said first face is brought into proximity of said second face, a magnetic attractive force is generated perpendicular to said first face and said second face, and wherein, when said first component is attached to said second component, said hall-effect sensor detects a presence of a magnetic field from said magnet element to provide current to said power relay switches, thereby triggering said power relay switches into an ON position.

4. The apparatus according to claim 2, further comprising a first indicator light circuit in said first component, and a second indicator light circuit in said second component for indicating establishment of said electrical path.

5. The apparatus according to claim 2, wherein said electrical contacts are symmetrically located on said first face and said second face.

6. The apparatus according to claim 2, wherein said first set of electrical contacts are disposed in an isosceles triangular fashion to define said first triangle on said first face; and wherein said second set of electrical contacts are disposed in an isosceles triangular fashion to define said second triangle on said second face such that said first triangle and said second triangle are congruent to each other.

7. The apparatus according to claim 2, wherein said first component comprises a recess having an asymmetrical shape formed on said first face, while said second component comprises a protrusion formed on said second face, said recess and said protrusion having a shape complementary to each other so as to ensure said first face and said second face to be connected only in one specific orientation.

* * * * *